United States Patent [19]

Halbritter et al.

[11] Patent Number: 4,857,360

[45] Date of Patent: Aug. 15, 1989

[54] PROCESS FOR THE MANUFACTURE OF NBN SUPERCONDUCTING CAVITY RESONATORS

[75] Inventors: Jürgen Halbritter, Bruchsal-Untergrombach; Hartmut Baumgärtner, Neuthard-Karlsdorf, both of Fed. Rep. of Germany

[73] Assignee: Kernforschungszentrum Karlsruhe GmbH, Karlsruhe, Fed. Rep. of Germany

[21] Appl. No.: 24,830

[22] Filed: Mar. 12, 1987

[30] Foreign Application Priority Data

Mar. 12, 1986 [DE] Fed. Rep. of Germany ..... 3608160

[51] Int. Cl.[4] ..... B05D 5/12; C23C 8/06

[52] U.S. Cl. ..... 427/62; 148/6.3; 148/281; 148/7 RC; 427/255.4; 333/99 S; 505/818; 505/819; 505/866

[58] Field of Search ..... 427/62, 63, 255.4; 148/6.3; 333/99 S

[56] References Cited

U.S. PATENT DOCUMENTS

| | | | |
|---|---|---|---|
| 4,227,153 | 10/1980 | Birx | 328/59 |
| 4,229,861 | 11/1981 | Dietrich et al. | 427/62 |
| 4,414,487 | 11/1983 | Yamashita et al. | 315/5 |
| 4,617,040 | 10/1986 | Yoshino | 62/37 |

OTHER PUBLICATIONS

Padamsee et al., *J. Appl. Phys.*, 50(2), Feb. 1979, pp. 1112–1115.

Christensen et al., *Acta Chem. Scand.*, A31, (1977), No. 1, pp. 77–78.

*Chemical Abstracts*, vol. 93, No. 16, 1980, (Abstract No. 159859d).

*Chemical Abstracts*, vol. 95, No. 2, 1981, (Abstract No. 17,210c).

Mohr, "Improved Quality of Josephson Junctions . . . ," *IBM Tech. Discl. Bull.*, (vol. 22, No. 7, Dec. 79), p. 2899.

Journal of Applied Physics, 52, (1981), 921, Isagawa.

"Measurements of Superconducting $Nb_3Sn$ Cavities in the GHz Range", IEEE Transactions on Magnetics, vol. Mag–15, No. 1, Jan. 1979, Kneisel, et al.

Thesis on the Superconductivity of Nb–Surfaces, J. Halbritter, University of Karlsruhe and Kernforschungszentrum Karlsruhe, FDR, 1984, pp. 102, 104, 124.

*Primary Examiner*—Norman Morgenstern
*Assistant Examiner*—Margaret Bueker
*Attorney, Agent, or Firm*—Nils H. Ljungman

[57] ABSTRACT

The quality of superconducting cavity resonators depends to a very great extent on the surface quality of the cavities. The invention relates to a process for the manufacture of superconducting cavity resonators with improved surface quality, whereby even complex shaped cavity resonators can be made with cavities coated with NbN.

20 Claims, No Drawings

PROCESS FOR THE MANUFACTURE OF NBN SUPERCONDUCTING CAVITY RESONATORS

BACKGROUND OF THE INVENTION

1. Field of the Invention

The invention relates to a process for the manufacture of superconducting cavity resonators and more particularly to the manufacture of superconducting cavity resonators having cavities lined with niobium nitride NbN.

2. Description of the Prior Art

Superconducting cavity resonators are becoming increasingly important because their use makes possible high degrees of efficiency in accelerators for ionized particles.

Most superconducting high-frequency resonators are based on niobium (Nb). Since the losses are very low in such resonators, new surface effects are observed quantitively and qualitatively, which are responsible for the performance of superconducting resonators, which differ significantly from the results which might be expected from resonators with ideal surfaces.

The quality of superconducting resonators depends to a very great extent on the surface characteristics and quality of the cavities.

Niobium resonators themselves, on account of the critical temperature $T_c \cong 9$ K at 4.2 K, do not have high field strengths and high-frequency qualities. These properties of niobium resonators are discussed in a thesis by J. Halbritter, University at Karlsruhe and Kernforschungszentrum Karlsruhe (KfK), Karlsruhe, Federal Republic of Germany, 1984, at pages 102, 104 and 124. Also, the thesis indicated that radiation damage occurred in heavily oxidized niobium cavities.

$Nb_3Sn$ resonators, of course on account of a $T_c \cong 18$ K, have the potential of achieving high critical fields and high frequency qualities even at 4.2 K, but they exhibit a poor surface quality. These mediocre results with $Nb_3Sn$ have been obtained for various preparation techniques and surface treatments in all labs working with $Nb_3Sn$. (See IEEE Transactions on Magnetics, Vol. Mag-15, No. 1, January 1979, Kneisel, Stoltz, Halbritter, entitled, "Measurements of Supeconducting $Nb_3Sn$ Cavities in the GHz Range".

NbN coatings on niobium surfaces are described in Journal of Applied Physics 52 (1981) 921, Isagawa. The NbN is deposited on the surface by sputtering, but that process produces poor quality and low field strengths, although a critical temperature of $T_c \cong 16$ K is achieved.

Some examples of superconducting cavity resonators are found in U.S. Pat. No. 4,414,487, entitled "Superconducting Electron Beam Generator" and U.S. Pat. No. 4,227,153, entitled "Pulse Generator Utilizing Superconducting Apparatus". Some examples of cryogenics and related matter are found in the following references: *Advances in Cryogenic Engineering,* P. Kneisel, O. Stoltz, J. Halbritter, Vol. 22 Plenum Press, New York, 1977), p.341; IEEE Transactions MAG-13, P. Kneisel, H. Kupfer, W. Schwarz, O. Stoltz, J. Halbritter, 496 (1977); *Advances in Cryogenic Engineering,* P. Kneisel, H. Kupfer, O. Stoltz, J. Halbritter, Vol. 24 (Plenum Press, New York, 1978), p.442; *Proc.* 15th Int. Conf. on Low Temperature Physics, J. Halbritter, Grenoble, 1978; J. de Physique C6, 396 (1978); *IEEE Transactions MAG*-11, 427 (1975); *Int. Bericht,* P. Kneisel, W. Meyer, (IK Kernforschungszentrum, Karlsruhe, 1978); *Z. Phys.* 266, J. Halbritter, 209 (1974); J. *Appl. Phys.* 48, W. Schwarz, J. Halbritter, 4618 (1977); and *Appl. Superconduct. Conf., Annapolis,* 1972, J. Halbritter, 1972 (IEEE, N.Y. 1972), p. 662. All of the above-mentioned documents and patents are incorporated herein by reference as if the contents thereof were set forth herein in their entirety.

OBJECTS OF THE INVENTION

An object of the invention is for the manufacture of superconducting cavity resonators with an improved surface quality for high-frequency superconduction.

Another object of the invention is to provide a niobium nitride surface with improved critical temperature, Tc.

A further object of the invention is to provide a method of manufacturing a high quality niobium nitride surface on niobium.

SUMMARY OF THE INVENTION

One embodiment of the invention relates to a process for making a superconducting cavity resonator having at least one surface comprising niobium nitride. The process comprises the following steps: heating a cavity for a superconducting cavity resonator having at least one surface comprising niobium to a temperature in a predetermined temperature range; and exposing the at least one surface comprising niobium to a gas chosen from a member of the group consisting esentially of nitrogen gas and a mixture of at least one noble gas and nitrogen gas. The temperature is in a range to permit formation of a niobium nitride layer on the at least one surface comprising niobium.

A further embodiment of the invention relates to a process for making a niobium nitride layer on an object having at least one surface comprising niobium. The process comprises the following steps: heating the object having at least one surface comprising niobium to a temperature in a predetermined temperature range; and exposing the at least one surface comprising niobium to a gas comprising at least one component including nitrogen. The temperature is in a range to permit formation of a niobium nitride layer on the at least one surface comprising niobium.

An alternative embodiment of the invention relates to a process for the manufacture of superconducting cavity resonators with cavities lined with NbN, wherein the cavity resonators comprise Nb on at least their inner surfaces and are subjected to a heat treatment at a temperature in the range of 300°–1800° C., and the Nb surfaces of the cavities are placed in contact with extremely pure $N_2$ or a mixture of $N_2$ and noble gas.

Yet another embodiment of the invention relates to a process for making a cavity. The Nb surfaces of the cavities are heated to a temperature up to about 1800° C., and then the temperature is set at a value between about 300° C. and approximately about 1200° C. At this temperature, the $N_2$ or the mixture of $N_2$ and noble gas for the reaction is placed in contact with the Nb surfaces and after the reaction, a rapid cooling is initiated to a temperature of less than 200° C. The rapid cooling is slow enough so as not to damage the cavity and fast enough to obtain a desired layer of NbN.

In another embodiment of the invention, the rapid cooling proceeding to a temperature of less than 200° C. is accomplished by flooding the resonator with cold $N_2$ or a mixture of $N_2$ and noble gas.

DESCRIPTION OF THE PREFERRED EMBODIMENTS

The advantage of the invention is that even complex-shaped superconducting cavity resonators having cavities lined with NbN can be manufactured, whereby the surface quality of the NbN produced according to the process described by the invention is better than the NbN produced according to the sputtering method from Nb or $Nb_3Sn$. The extremely pure $N_2$ gas, that is preferably nitrogen gas, which is preferably as pure as presently available or can be produced, and the clean Nb surface prevent nonuniformities in the NbN. The rapid cooling produces the δ-NbN phase, which results in a critical temperature of $T_c \cong 17K$. The superconducting high-frequency resonators produced according to the method of an embodiment of the invention, exhibit improved operating characteristics, such as, high-frequency quality and long term stability at 4.2K. With the use of high purity $N_2$ gas, contamination of the Nb with oxygen is prevented. The present process, according to an embodiment of the invention, achieves a reduction of the residual resistance of the Nb.

The following sample will serve to illustrate the process according to an embodiment of the invention.

The cavity resonators manufactured from Nb are heated in an ultra-high vacuum (UHV) furnace to 1800° C. to remove the residual oxygen from a surface layer. The temperature is reduced to approximately 600° C. and the UHV furance is flooded with high-purity $N_2$ gas whereby the Nb on the surface reacts with the $N_2$ to form NbN, to a depth, which is a function of the operating conditions and/or the duration of the exposure, here, for example, approximately 0.1 micron (micrometer). Typically, in an embodiment of the invention, the cavity is cooled in the ultra-high vacuum furance to a temperature of 600° C. at a pressure of $10^{-2}$ Torr $N_2$ and then flooded with 1000 Torr $N_2$ for the rapid cooling. Then the desired rapid cooling is continued to at least 50° C., whereby the δ-NbN phase remains intact, which makes possible a critical temperature of $T_c \cong 17$ K. The control of the temperature gradient during the cooling phase can be accomplished, for example, by a controlled introduction of the $N_2$ gas, whereby its entry temperature and the pressure in the UHV furnace are taken into consideration. An example of an ultra-high vacuum furnace for use in practicing embodiments of the invention is a UHV Oven made by Heterinton (Varian). An example of a patent relating to high purity nitrogen is U.S. Pat. No. 4,617,040 entitled "Highly Pure Nitrogen Gas Producing Apparatus", which patent is incorporated herein by reference as if the contents thereof were set forth herein in its entirety.

The process is not limited to cavity resonators made of Nb. This process can be used with materials or objects coated with Nb or containing Nb.

The invention as described hereinabove in the context of the preferred embodiments is not to be taken as limited to all of the provided details thereof, since modifications and variations thereof may be made without departing from the spirit and scope of the invention.

What is claimed is:

1. A process for making a superconducting cavity resonator having at least one surface comprising niobium nitride, said process comprising the following steps:

heating a cavity for a superconducting cavity resonator having at least one surface comprising niobium to a temperature in a predetermined temperature range; and rapidly cooling by flooding to a temperature below 200° C. said at least one surface comprising niobium with a gas chosen from a member of the group consisting essentially of nitrogen gas and a mixture of at least one noble gas and nitrogen gas and forming a niobium nitride layer on said at least one surface comprising niobium;

said heating temperature being in a range of from about 300° C. to about 1800° C. to permit formation of said niobium nitride layer for superconducting resonance on said at least one surface comprising niobium upon said rapid cooling.

2. The process according to claim 1, wherein said predetermined temperature range for heating is about 300° C. to about 1800° C.

3. The process according to claim 1, wherein said at least one surface comprising niobium is at a temperature in a range of about 300° C. to about 1200° C. when being exposed to said gas.

4. The process according to claim 2, wherein said at least one surface comprising niobium is at a temperature in a range of about 300° C. to about 1200° C. when being exposed to said gas.

5. The process according to claim 1, wherein, following the exposure of said at least one surface comprising niobium to said gas to form said niobium nitride layer, said niobium nitride layer is cooled, and wherein cooling the niobium nitride layer is done according to a predetermined rate profile to form said niobium nitride layer for super-conducting resonance on said at least one surface comprising niobium.

6. The process according to claim 4, wherein, following the exposure of said at least one surface comprising niobium to said gas to form said niobium nitride layer, said niobium nitride layer is cooled and wherein cooling the niobium nitride layer is done according to a predetermined rate profile to form said niobium nitride layer for super-conducting resonance on said at least one surface comprising niobium.

7. The process according to claim 1, wherein, following the exposure of said at least one surface comprising niobium to said gas to form said niobium nitride layer, said niobium nitride layer is cooled, and wherein said cooling is done at said predetermined rate to a predetermined cool temperature to preserve a δ-NbN phase formed in said layer.

8. The process according to claim 7, wherein, following the exposure of said at least one surface comprising niobium to said gas to form said niobium nitride layer, said niobium nitride layer is cooled, and wherein said predetermined cool temperature is below about 50° C.

9. The process according to claim 6, wherein said niobium nitride layer is cooled to a predetermined cool temperature, and wherein said predetermined cool temperature is below about 50° C.

10. The process according to claim 1, wherein said exposing of said at least one surface of said gas is continued for a time to provide a layer of said NbN of about 0.1 micrometer.

11. The process according to claim 5, wherein said exposing to said gas provides said cooling.

12. The process according to claim 11, wherein said gas has a temperature of below about 50° C. for said cooling.

13. The process according to claim 5, wherein said cooling rate is faster to a temperature of less than about 200° C. and then at a slower rate below about 200° C.

14. The process according to claim 9, wherein said cooling rate is faster to a temperature of less than about 200° C. and then at a slower rate below about 200° C.

15. The process according to claim 1, wherein said gas floods said resonator to provide said cooling.

16. The process according to claim 14, wherein said gas floods said resonator to provide said cooling.

17. A process for making a niobium nitride layer on an object having at least one surface comprising niobium, said process comprising the following steps:

heating said object having at least one surface comprising niobium to a temperature in a predetermined temperature range; and rapidly cooling by flooding to a temperature below 200° C. said at least one surface comprising niobium with a gas comprising at least one component including nitrogen gas and forming a niobium nitride layer ove the niobium of said at least one surface comprising niobium;

said heating temperature being in a range of from about 300° C. to about 1800° C. to permit formation of a niobium nitride layer on said at least one surface comprising niobium upon said rapid cooling.

18. The process according to claim 17, wherein said gas is chosen from a member of the group consisting essentially of nitrogen gas and a mixture of at least one noble gas and nitrogen gas.

19. The process according to claim 1, wherein said niobium nitride layer formed is substantially uniform.

20. The process according to claim 17, wherein said niobium nitride layer formed is substantially uniform.

* * * * *